US005498124A

United States Patent [19]

Ito et al.

[11] Patent Number: 5,498,124

[45] Date of Patent: Mar. 12, 1996

[54] REGENERATIVE PUMP AND CASING THEREOF

[75] Inventors: Motoya Ito, Anjo; Minoru Yasuda, Chiryu; Atsushige Kobayashi, Nagoya, all of Japan

[73] Assignee: Nippondenso Co., Ltd., Kariya, Japan

[21] Appl. No.: 190,466

[22] Filed: Feb. 2, 1994

[30] Foreign Application Priority Data

Feb. 4, 1993 [JP] Japan ..... 5-017281
Dec. 22, 1993 [JP] Japan ..... 5-324067

[51] Int. Cl.[6] ..... F04D 17/06

[52] U.S. Cl. ..... 415/55.1

[58] Field of Search ..... 415/55.1, 55.2, 415/55.3, 55.4, 55.5

[56] References Cited

U.S. PATENT DOCUMENTS

| | | | |
|---|---|---|---|
| 2,220,538 | 7/1937 | Neibert . | |
| 3,252,421 | 5/1966 | Luhmann . | |
| 4,478,550 | 10/1984 | Watanabe et al. . | |
| 5,011,367 | 4/1991 | Yoshida et al. . | |
| 5,372,475 | 12/1994 | Kato et al. | 415/55.1 |
| 5,407,318 | 4/1995 | Ito et al. | 415/55.1 |

FOREIGN PATENT DOCUMENTS

| | | |
|---|---|---|
| 974737 | 4/1961 | Austria . |
| 9104728.5 | 10/1992 | Germany . |
| 4300368 | 7/1993 | Germany . |
| 56-120389 | 9/1981 | Japan . |
| 60-173390 | 9/1985 | Japan . |
| 2-103194 | 8/1990 | Japan . |
| 2073819 | 10/1981 | United Kingdom . |

*Primary Examiner*—John T. Kwon
*Attorney, Agent, or Firm*—Cushman, Darby & Cushman

[57] ABSTRACT

A regenerative pump includes a casing which a recessed fluid flow passage interconnecting a suction port and a discharge port is formed in an arcuate shape. An impeller is provided rotatably with respect to the casing and formed with a plurality of vane members which face the recessed fluid flow passage. A recessed damping portion is formed in a terminal end portion of the recessed fluid flow passage on a discharge port side thereof to begin at a position corresponding to the discharge port and extend along a rotating direction of the impeller. The recessed damping portion has a depth which is smaller than that of a main depth of the recessed fluid flow passage and substantially constant.

21 Claims, 13 Drawing Sheets

REGENERATIVE PUMP AND CASING THEREOF

BACKGROUND OF THE INVENTION

The present invention relates to a regenerative pump for pressurizing and supplying a fluid, and a casing thereof, which pump is suitably used as a fuel pump for an automobile.

Generally, a regenerative pump is used as a small-sized pump which delivers a small amount of liquid of a low viscosity under a high pumping pressure, and it has recently been employed as, for example, a fuel pump for an automobile. In the case of such a fuel pump, to satisfy present social demands such as saving of natural resources and environmental protection, reduction of fuel consumption (decrease of the alternator load) by improving the pumping efficiency has been an important technical problem in recent years.

By the way, in a regenerative pump of this type, a fluid pressurized and supplied by an impeller is delivered to a discharge port after it collides against a terminal end portion of a pump flow passage. At this time, the fluid on the casing body side, i.e., on the side where the discharge port is formed, can move to the discharge port. However, the fluid on the casing cover side, i.e., on the side where no discharge port is provided, stops against the inner peripheral portion of the flow passage, conspicuously increasing a pressure of the fluid. Besides, when the circumferential direction of the impeller is considered, the pressure of the fluid in the vicinity of the front side of vane members (the downstream side of the fluid flow) is the highest so that the pressure will be increased periodically every time the vane members are located at the terminal end portion of the flow passage during the rotation, thereby generating noises of a frequency corresponding to a product of the number of the vane members and the rotational speed.

The following has been known as a technique for preventing such noises at the terminal end portion of the flow passage.

A water pump which utilizes a regenerative pump (Westco pump) is disclosed in Japanese Utility Model Unexamined Publication No. 56-120389. In this pump, as shown in FIG. 22, an inclined surface 23 is formed at a terminal end portion of a fluid passage 22 which is formed in a casing cover 21. Consequently, a fluid which has been pressurized and supplied through the fluid passage 22 by the rotation of an impeller 24 successively collides against the inclined surface 23 so that noises caused by collision of the fluid can be reduced as compared with the structure in which the terminal end portion is closed by a vertical wall.

A fuel pump which utilizes a regenerative pump is disclosed in Japanese Utility Model Unexamined Publication No. 2-103194. This fuel pump comprises an impeller including vane grooves formed in peripheral edge portions of both the surfaces of the impeller, and a casing in which this impeller is housed. In this conventional technique, noise reduction has been tried. A chamfered surface 27, as shown in FIG. 24, is formed in a terminal end portion of a fluid flow passage 26 of a casing cover 25, as shown in FIG. 23. As a result, noises at the terminal end of the flow passage can be reduced.

However, the above-described structures of the conventional techniques involve a problem that sufficient noise reduction can not be effected.

This problem is induced for the following reasons. For example, in the pump shown in FIG. 22, since the terminal end of the inclined surface 23 is closed on a straight line in parallel to each vane of the impeller, the fluid which has collided against the inclined surface 23 eventually collides on the boundary line at the terminal end of the inclined surface 23 at once, so that noises can not be sufficiently reduced. Further, even if the terminal end of the flow passage is circular, as shown in FIG. 23, the fuel collides against the circular terminal end surface at once without much time differences, and therefore, noises can not be sufficiently reduced. Moreover, in the configuration shown in FIG. 22 or 23, substantially the entire surface of each vane of the impeller enters a partition portion simultaneously, so that noise reduction can not be adequately effected.

Furthermore, the inclined surface and the chamfered surface described above involve a problem that it is difficult to work the pump flow passage into a desired shape while maintaining the plane accuracy of the inner surface of the casing.

The inner surfaces of a casing body and a casing cover require a high plane accuracy because the impeller slidingly moves therein. Therefore, the inner surfaces of the casing body and the casing cover formed by die casting are ground to obtain a predetermined plane accuracy. In this case, when an inclined surface or a chamfered surface is formed on the casing cover or the casing body, as in the conventional techniques, the terminal end line of the inclined surface or the terminal end line of the chamfered surface is deviated as a result of grinding of the inner surface.

If inclined surfaces or chamfered surfaces are formed on both the casing cover and the casing body, the inner surfaces of the casing body and the casing cover are ground individually so that the terminal end line on the casing cover side may be deviated from the terminal end line on the casing body side in every product, as indicated by the dashed line in FIG. 24. Such a deviation of the terminal end lines causes a variation in the length of a sealed portion formed between the discharge port and the suction port, which results in a fear that a constant performance can not be obtained.

In this manner, the conventional techniques have not only the problem that sufficient noise reduction can not be effected but also the problem that the configurations are not suitable for practical use.

SUMMARY OF THE INVENTION

Taking the above-described problems of the conventional techniques into account, the present invention has an object to provide a regenerative pump having a novel structure which reduces noises generated at a terminal end of a pump flow passage.

Also, the invention has an object to provide a regenerative pump having a practical structure which reduces noises generated at a terminal end of a flow passage.

The invention has another object to provide a casing having a practical structure which reduces noises generated at a terminal end of a flow passage.

In order to achieve the above object, employed according to an aspect of the invention is the following technical means.

A regenerative pump comprising a casing in which a recessed fluid flow passage interconnecting a suction port and a discharge port is formed in an arcuate shape, and an impeller provided rotatably with respect to the casing and formed with a plurality of vane members which face the recessed fluid flow passage, wherein a recessed damping portion is formed in a terminal end portion of the recessed fluid flow passage on the discharge port side thereof to extend beyond a position corresponding to the discharge port along a rotating direction of the impeller, and the recessed damping portion has a depth which is smaller than that of a main range of the recessed fluid flow passage and substantially constant.

Preferably, the recessed damping portion is defined by a boundary line which causes each vane member of the impeller to enter a partition portion gradually.

Provided according to another aspect of the invention is a regenerative pump comprising a casing in which a recessed fluid flow passage interconnecting a suction port and a discharge port is formed in an arcuate shape, and an impeller provided rotatably with respect to the casing and formed with a plurality of vane members which face the recessed fluid flow passage, wherein a recessed damping portion is formed in a terminal end portion of the recessed fluid flow passage on the discharge port side thereof to extend beyond a position corresponding to the discharge port along a rotating direction of the impeller, and the recessed damping portion is surrounded by a vertical wall which extends substantially perpendicularly to inner surfaces of the casing.

Preferably, the damping portion has a depth smaller than that of a main range of the recessed fluid flow passage.

Further, it is preferable that the vertical wall include a wall surface which causes each vane member of the impeller to enter a partition portion gradually.

Preferably, the casing extends in a range which holds the impeller from both opposite sides thereof, the recessed fluid flow passage includes a first section which faces one of the surfaces of the impeller and a second section which faces the other surface of the impeller, and the discharge port extends from the terminal end of the first section perpendicularly to the surfaces of the impeller.

The damping portion may be formed only in the terminal end portion of the second section, or both in the terminal end portion of the second section and in the terminal end portion of the first section, or only in the terminal end portion of the first section.

Further provided according to still another aspect of, the invention is a regenerative pump comprising a casing in which a recessed fluid flow passage interconnecting a suction port and a discharge port is formed in an arcuate shape, and an impeller provided rotatably with respect to the casing and formed with a plurality of vane members which face the recessed fluid flow passage, wherein a terminal end portion of the recessed fluid flow passage on the discharge port side thereof is defined by a boundary line which causes each of the vane members to enter a partition portion gradually.

In any one of the regenerative pumps of the invention having the above-described structures, the impeller may be formed in a disk-like shape, and the vane members may be individually formed on one end face of the impeller and on the other end face thereof.

Alternatively, the impeller may be formed in a disk-like shape, and the vane members may be formed to extend continuously from one of the end faces of the impeller to the other end face thereof, respectively.

Further, the vane members of the impeller may be concave with respect to the rotating direction of the impeller.

Any one of the regenerative pumps of the invention having the above-described structures can be used as a fuel pump for supplying fuel to an internal combustion engine.

Provided according to still another aspect of the invention is a casing for co-operating with an impeller in pressurizing a fluid, the impeller having a plurality of vane members and vane grooves alternately formed in an annular form, wherein a recessed fluid flow passage is formed in an arcuate form corresponding to an annular row of the vane members of the impeller to extend from an end thereof corresponding to a fluid suction port to a terminal end thereof corresponding to a fluid discharge port, and the terminal end of the recessed fluid flow passage is defined by a boundary line which permits each of the vane members to enter a partition portion gradually.

Preferably, the boundary line define a recessed damping portion which is formed to extend beyond a position corresponding to the fluid discharge port along a rotating direction of the impeller.

Preferably, a wall surface or the boundary line which permits each vane member to enter the partition portion gradually is inclined with respect to the vane members. More preferably, it is inclined at least over a range corresponding to a pitch between adjacent vane members of the impeller.

Provided according to still another aspect of the invention is casing for co-operating with an impeller in pressurizing a fluid, the impeller having a plurality of vane members and vane grooves alternately formed in an annular form, wherein a recessed fluid flow passage is formed in an arcuate form corresponding to an annular row of the vane members of the impeller to extend from an end thereof corresponding to a fluid suction port to a terminal end thereof corresponding to a fluid discharge port, a damping portion is formed in the terminal end of the recessed fluid flow passage and extends beyond a position corresponding to the fluid discharge port along a rotating direction of the impeller, and the damping portion has a substantially constant depth smaller than that of a main depth of the recessed fluid flow passage.

The function of the above pumps according to the invention will now be described.

When the impeller is rotated, a fluid is drawn from the suction port and supplied under a pressure to the discharge port in accordance with the movement of the vane members formed on the outer periphery of the impeller. At this time, the fluid flows through the recessed fluid flow passage formed in the casing and collides against the terminal end portion of the recessed fluid flow passage before it reaches the discharge port. Meanwhile, the vane members of the impeller enter the partition portion from the terminal end of the recessed fluid flow passage, and then, move out to the suction port side again.

At this time, according to the first aspect of the invention, the recessed damping portion is formed to have a small depth and further extend beyond the terminal end portion along the rotating direction of the impeller, so that generation of noises can be suppressed.

Moreover, according to the second aspect of the invention, the recessed damping portion further extends beyond the terminal end portion along the rotating direction of the impeller, and also, the damping portion is surrounded by the vertical wall, so that the recessed damping portion decreases generation of noises, and that the damping portion will not be deformed even when the inner surfaces of the casing are ground to attain plane accuracy.

Furthermore, according to the other aspects of the invention, the terminal end portion of the recessed or the damping portion formed therein fluid flow passage causes each vane member of the impeller to enter the partition portion gradually, and consequently, generation of noises can be suppressed as compared with another casing where the entire surface of each vane member enters the partition portion at once.

DETAILED DESCRIPTION OF THE PREFERRED EMBODIMENTS

A first embodiment in which the present invention is applied to a fuel pump for an automobile will be hereinafter described with reference to the attached drawings.

Figure 1:
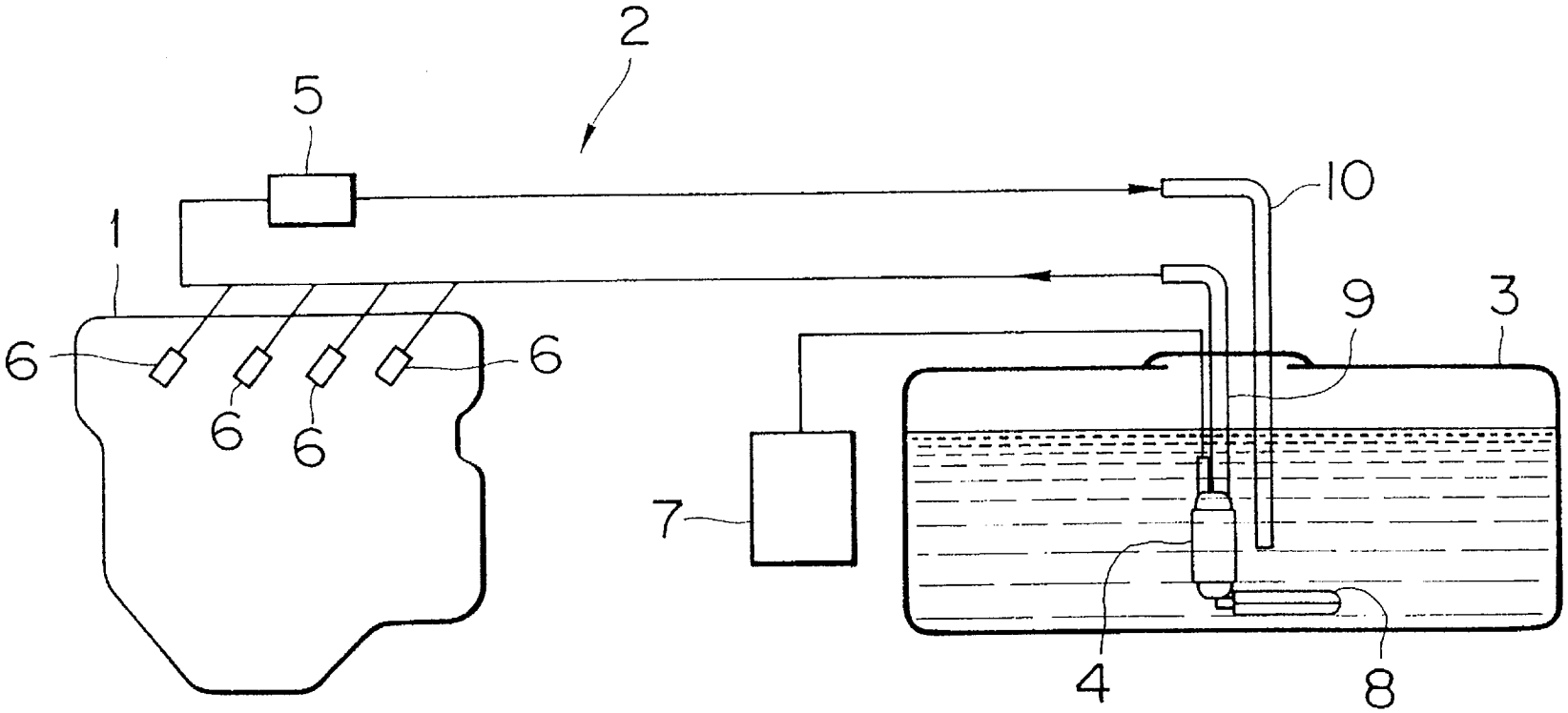
FIG. 1 is a diagram showing the structure of a fuel supply system for a vehicle.

FIG. 1 is a diagram schematically showing the structure of a fuel supply apparatus 2 of an automobile engine 1.

The fuel supply apparatus 2 comprises a fuel pump 4 provided in a fuel tank 3, a regulator 5 for regulating a pressure of fuel discharged from the fuel pump 4, injectors 6 for injecting and supplying the fuel to cylinders of the engine 1, and pipes for connecting these components. When supplied with power from a battery 7 mounted on the automobile, the fuel pump 4 is actuated to draw fuel through a filter 8 and discharge it into a discharge pipe 9. On the other hand, excess fuel discharged from the regulator 5 is returned into the fuel tank 3 by way of a return pipe 10.

Next, a structure of the fuel pump 4 will be described.

Figure 2:
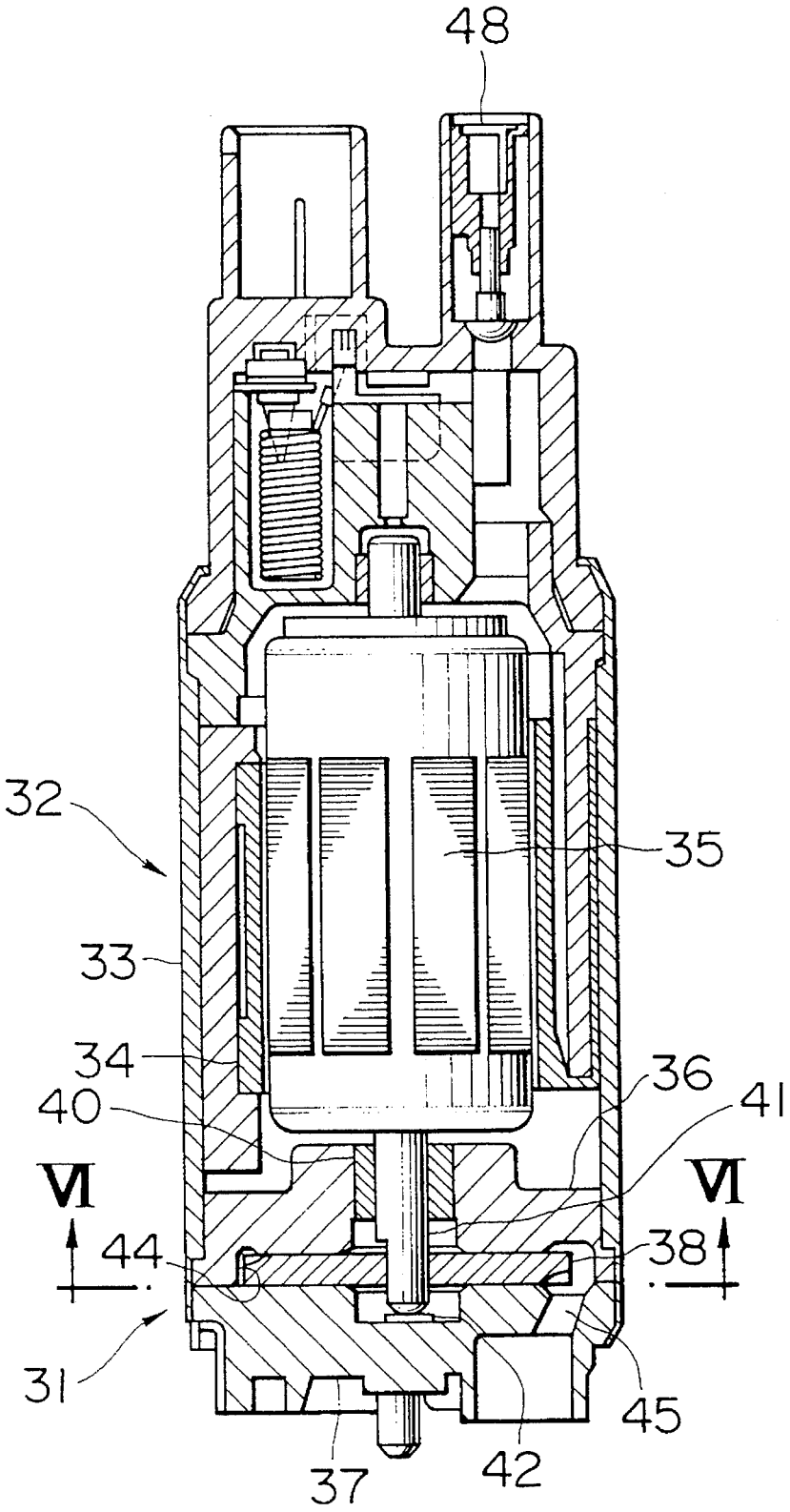
FIG. 2 is a vertical cross-sectional view showing a fuel pump of a first embodiment to which the present invention is applied.

FIG. 2 is a vertical cross-sectional view of the fuel pump 4.

The fuel pump 4 comprises a pump portion 31 and a motor portion 32 for driving the pump portion 31. The motor portion 32 is a direct-current motor with a brush and has the structure in which permanent magnets 34 are provided, in an annular form, in a cylindrical housing 33, and an armature 35 is provided concentrically on the inner peripheral side of the permanent magnets 34.

The structure of the pump portion 31 will now be described.

Figure 3:
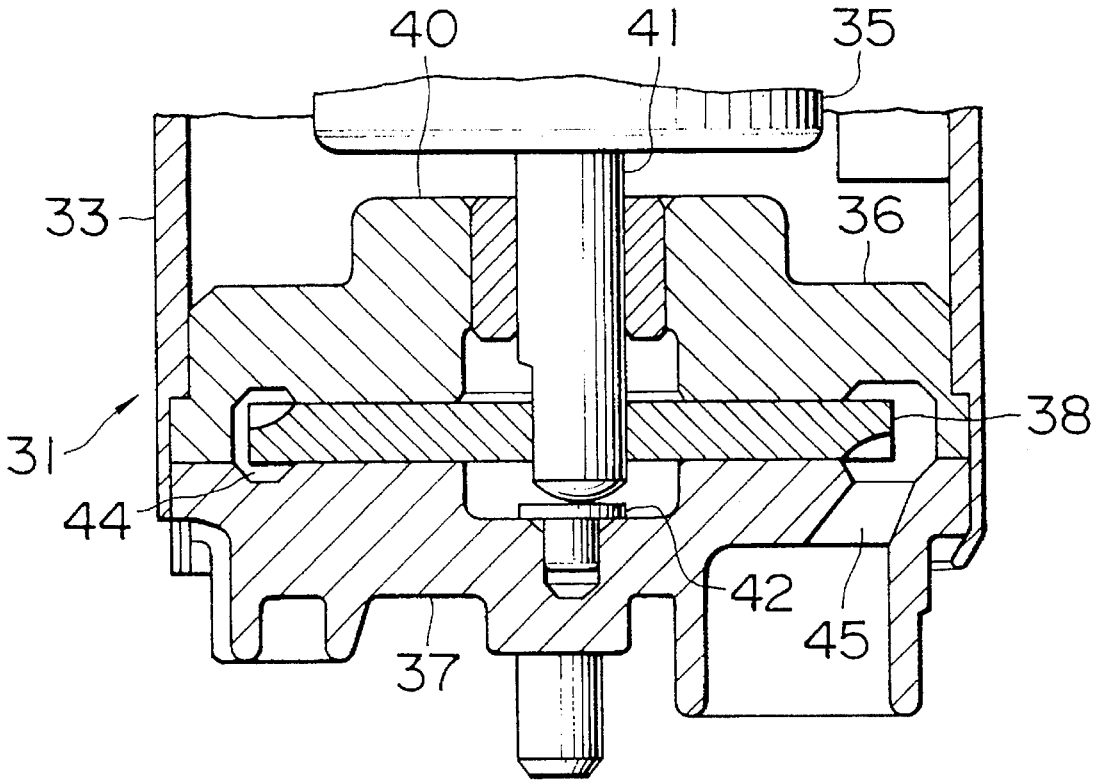
FIG. 3 is an enlarged cross-sectional view showing a pump portion of the fuel pump shown in FIG. 2.
Figure 4:
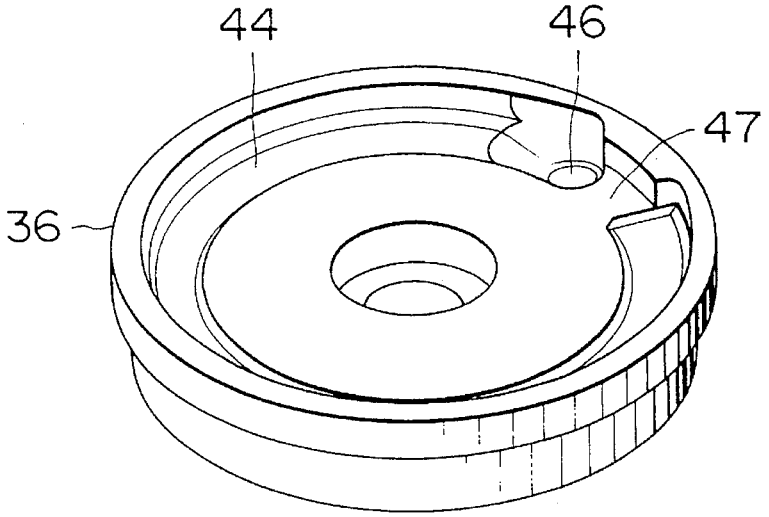
FIG. 4 is a perspective view showing a casing body.
Figure 5:
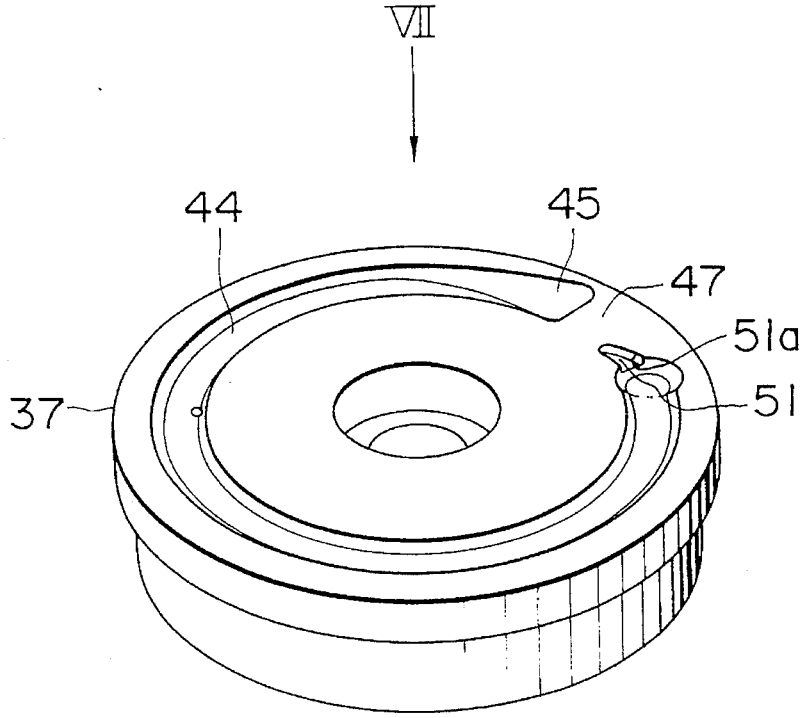
FIG. 5 is a perspective view showing a casing cover.

FIG. 3 is an enlarged view of the pump portion 31; FIG. 4 is a perspective view of a casing body 36; FIG. 5 is a perspective view of a casing cover 37; and FIG. 6 is a cross-sectional view taken along the line VI—VI of FIG. 2, as viewed in a direction of the arrows.

As shown in FIG. 3, the pump portion 31 comprises the casing body 36, the casing cover 37, an impeller 38 and so forth. The casing body 36 and the casing cover 37 are formed by die casting of, for example, aluminum. The casing body 36 is press-fitted in one end of the housing 33. A rotational shaft 41 of the armature 35 is penetrated through and supported in a bearing 40 which is secured in the center of the casing body 36. On the other hand, the casing cover 37 is placed over the casing body 36 and fixed in the one end of the housing 33 in this state by caulking or the like. A thrust bearing 42 is fixed in the center of the casing cover 37 so as to receive a thrust load of the rotational shaft 41. The casing body 36 and the casing cover 37 constitute a single casing in which the impeller 38 is rotatably housed.

Figure 6:
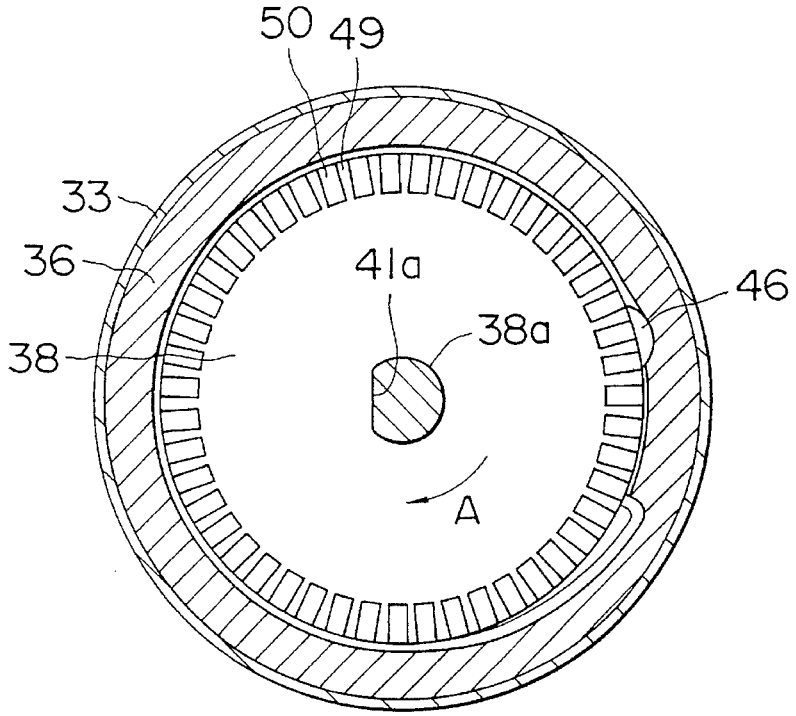
FIG. 6 is a cross-sectional view taken along the line VI—VI of FIG. 2, as viewed in a direction indicated by the arrows.

As shown in FIG. 6, a substantially D-shaped fitting hole 38*a* is formed in the center of the impeller 38, and is closely fitted on a D-cut portion 41*a* of the rotational shaft 41. Consequently, although the impeller 38 rotates integrally with the rotational shaft 41, it is slightly movable in the axial direction.

As shown in FIGS. 4 and 5, a pump flow passage 44 of an arcuate shape is defined between the casing body 36 and the inner surface of the casing cover 37. Further, a suction port 45 communicating with one end of the pump flow passage 44 is formed in the casing cover 37 whereas a discharge port 46 communicating with the other end of the pump flow passage 44 is formed in the casing body 36. A partition portion 47 for preventing reverse flows of fuel is formed between the suction port 45 and the discharge port 46. A damping portion 51 which is a triangular recess having a small depth is formed in a terminal end of the pump flow passage 44 of the casing cover 37. The damping portion 51 is surrounded by a vertical wall 51*a*.

The discharge port 46 is penetrated through the casing body 36 and connected to a space inside of the motor portion 32. Therefore, fuel discharged through the discharge port 46 passes the space inside of the motor portion 32 and is discharged through a fuel discharge port 48 (see FIG. 2) formed in the other end of the housing 33. On the other hand, the filter 8 (see FIG. 1) is attached outside of the suction port 45.

The impeller 38 is formed of, for example, a phenolic resin including glass fibers, PPS or the like. The impeller 38 is manufactured by resin molding and grinding of both the end surfaces and the outer peripheral surface of the impeller.

As shown in FIGS. 3 and 6, a plurality of vane members 49 are formed on both the surfaces of an outer peripheral portion of the disk-like impeller 38 at predetermined pitches while a vane groove 50 is defined between each two of the vane members 49. These vane members 49 are alternately formed on both the surfaces of the impeller 38. As shown in FIG. 3, each of the vane grooves 50 is designed to have such a curved bottom surface that the groove depth increases gradually toward the outer periphery of the impeller 38.

Next, the shape of the damping portion 51 will be described more specifically.

Figure 7:
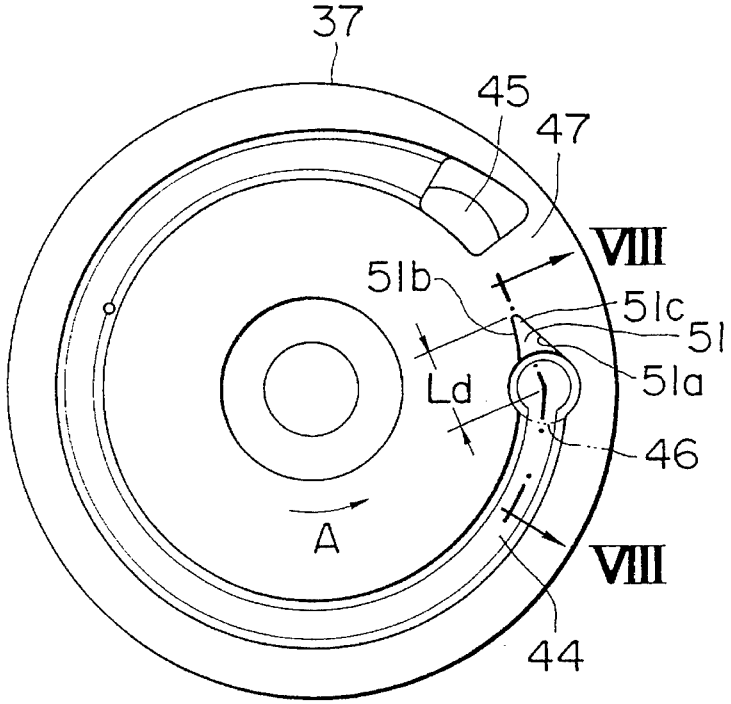
FIG. 7 is a plan view showing the casing cover.
Figure 8:
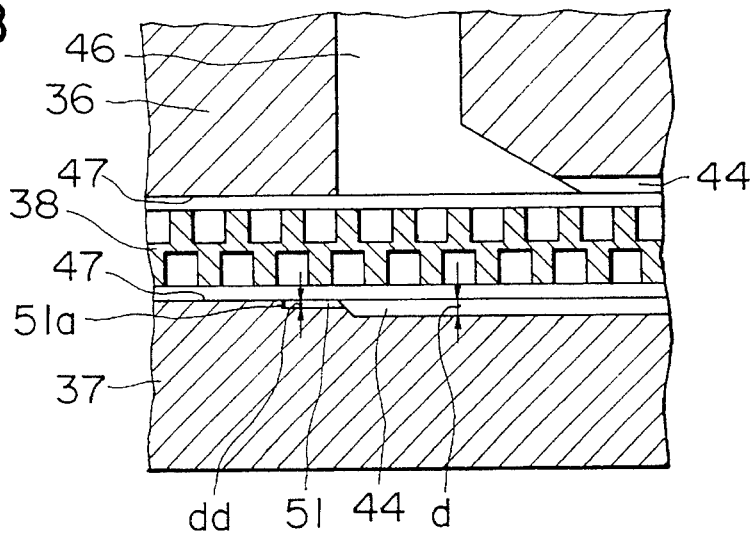
FIG. 8 is a cross-sectional view showing that portion of the fuel pump which is located in the vicinity of a terminal end of a flow passage, taken along the line VIII—VIII of FIG. 7.

FIG. 7 is a plan view of the casing cover 37, as viewed from a direction indicated by the arrow VII of FIG. 5. FIG. 8 is a cross-sectional view taken along the chain line VIII—VIII of FIG. 7, as viewed in a direction of the arrows, illustrating the positional relation of the impeller 38, the casing body 36 and the casing cover 37. In FIG. 8, a clearance between the impeller 38 and the casing body 36 and a clearance between the impeller 38 and the casing cover 37 are exaggerated.

As shown in FIG. 7, the triangular damping portion 51 is formed in the terminal end portion of the pump flow passage 44 formed in the casing cover 37. The damping portion 51 is formed as a recess having a smaller depth than the pump flow passage 44. The damping portion 51 is tapered along a rotating direction of the impeller 38 and is surrounded by the vertical wall 51*a* which extends perpendicular to the inner surface of the casing cover 37 (see FIG. 8).

Moreover, as shown in FIG. 8, the damping portion 51 extends along the rotating direction of the impeller 38 toward the downstream side of the vertically projected position of the discharge port 46. In FIG. 7, the vertically projected position of the discharge port 46 is depicted by the chain double-dashed line. The vertical wall 51*a* of the damping portion 51 comprises a circumferential wall surface 51*b* which extends substantially in parallel to the circumferential direction of rotation of the impeller 38 and which substantially corresponds to the bottom ends of the vane members 49 of the impeller 38, and a slanting wall surface 51*c* which extends from the outer side to the inner side in a direction slanting from the circumferential direction of rotation of the impeller 38. The slanting wall surface 51*c* substantially corresponds to a range from the outermost ends to the bottom ends of the vane members 49. Further, the slanting wall surface 51*c* is in contact with the inner surface of the casing cover 37 through a boundary line, which defines the damping portion 51. On the other hand, the circumferential wall surface 51*b* extends along the inner surface of the pump flow passage 44.

In the present embodiment, the diameter of the impeller 38 is determined at 30 mm, and the respective gaps (clearances) between the opposite surfaces of the impeller 38, and the inner surface of the casing body 36 and the inner surface of the casing cover 37 are determined at several μm to several tens μm. The width of the vane grooves 50 between the vane members 49 is determined at about 1.2 mm, and the gap (clearance) between the outer peripheral end of each vane member 49 and the inner surface of the pump flow passage 44 is determined at about 0.5 to 1.5 mm.

Further, the damping portion 51 is designed in such a manner that the depth dd is 0.2 mm, and that the length Ld from the center of the circular terminal-end portion of the pump flow passage 44 to the distal end of the triangular recess is 4 mm. The depth d of the pump flow passage 44 is 0.6 mm.

The function of the above-described structure will now be described. When a coil (not shown) of the armature 35 in the motor portion 32 is supplied with power and the armature 35 is rotated, the impeller 38 is rotated in the direction indicated by the arrow A of FIG. 7 integrally with the rotational shaft 41 of the armature 35. Thus, the vane members 49 on the outer periphery of the impeller 38 move along the arcuate pump flow passage 44 so as to cause a pumping function. Consequently, fuel is drawn from the suction port 45 into the pump flow passage 44, and the drawn fuel receives kinetic energy from the vane members 49 and is supplied, under a pressure, in the pump flow passage 44 toward the discharge port 46. Then, the fuel discharged from the discharge port 46 passes the space inside of the motor portion 32 and is supplied, under a pressure, from the fuel discharge port 48 to the injectors.

During the operation of such a fuel pump, noises are generated. In the above-described embodiment, however, the provision of the damping portion 51 serves to reduce the noises.

This noise reduction effect can be obtained presumably for the following reasons.

During the operation of the fuel pump, since the fuel pressurized and supplied in the pump flow passage 44 collides against the terminal end portion of the pump flow passage and changes its direction toward the discharge port 46, sounds of the collision become a source of the noises. In this case, sounds of the collision generated when the vane members 49 of the impeller 38 rotating at a high speed collide on the fuel drawn from the suction port 45 also become a source of the noises. (It should be noted that the noises generated at the side of the suction port 45 are smaller than the noises generated at the side of the discharge port 46.)

In this embodiment, however, the damping portion 51 is formed in the terminal end portion of the pump flow passage 44 on the side of the pump casing 37, so that part of the fuel which has reached the terminal end portion, especially the fuel which has been located in the vicinity of the impeller 38, flows into the damping portion 51 from the terminal end portion and collides against the vertical wall 51*a* surrounding the damping portion 51. At this time, since the damping portion 51 includes the slanting wall surface 51*c*, the fuel is prevented from colliding at once, thereby reducing the noises.

Moreover, since the slanting wall surface 51*c* slants substantially corresponding to the range from the outermost ends to the bottom ends of the vane members 49, the vane members 49 are gradually hidden in the partition portion 47 by the slanting wall surface 51*c*. As a result, as compared with the case in which the vane members 49 are hidden in the partition portion 47 at once, the noises are reduced.

According to the first embodiment described heretofore, the damping portion 51 is provided in the terminal end of the pump flow passage so that generation of the noises at the terminal end of the pump flow passage can be suppressed. Moreover, the damping portion 51 is surrounded by the vertical wall 51*a*, and consequently, even if the inner surface of the casing cover 37 is ground, the damping portion 51 is not deformed, and the length of the partition portion 47 is not changed. Therefore, the damping portion having a desired shape can be formed without influencing the pumping performance.

Furthermore, the damping portion 51 includes the slanting wall surface 51*c* which causes the vane members 49 of the impeller 38 to be gradually hidden in the partition portion 47, so that a particularly high noise preventing effect can be obtained.

In the first embodiment, the damping portion is surrounded by the vertical wall. However, the damping portion may be formed by an inclined surface in such a manner that a boundary line where the inclined surface intersects with the inner surface of the casing will be located at a position corresponding to the slanting wall surface 51*c*. With this structure, although the boundary line moves when the inner surface of the casing is ground, the boundary line slants with respect to the vane members of the impeller, thereby obtaining a high noise preventing effect.

Although, in the first embodiment, the damping portion 51 is formed only in the casing cover 37, a similar damping portion may be formed in the casing body 36 as well. When both the casing cover and the casing body are formed with the damping portions, pressures exerted on both sides of the impeller 38 can be balanced.

In the first embodiment, the bottom surface of the damping portion 51 is flat. However, when it is a slightly slanting surface, the noise reduction effect can be obtained in substantially the same manner as the first embodiment.

Further, in the first embodiment, the damping portion 51 has a triangular shape. However, the shape may be changed as desired.

Next, a second embodiment to which the present invention is applied will be described.

In the second embodiment, the impeller 38 in the first embodiment is changed into an impeller disclosed in Japanese Patent Application No. 5-35405.

Figure 9:
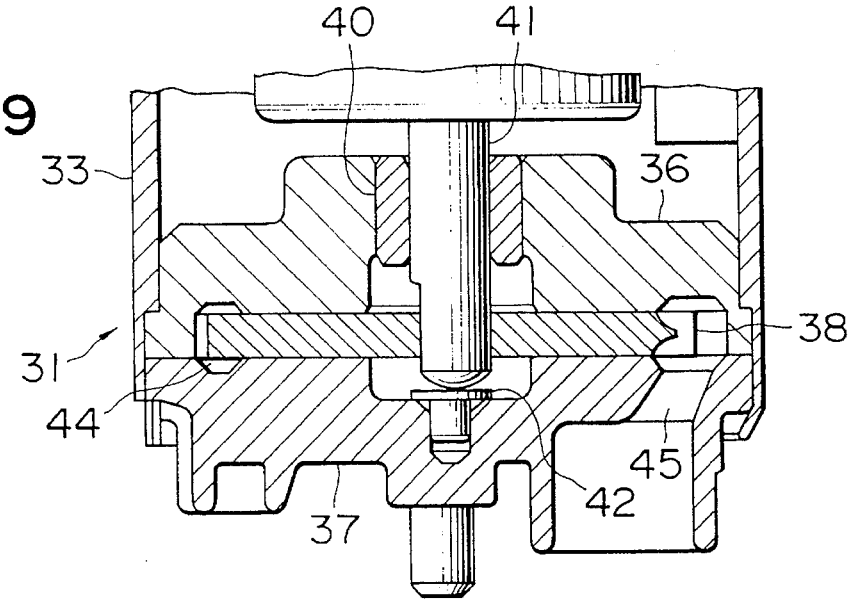
FIG. 9 is a cross-sectional view showing a pump portion of a second embodiment to which the invention is applied.
Figure 10:
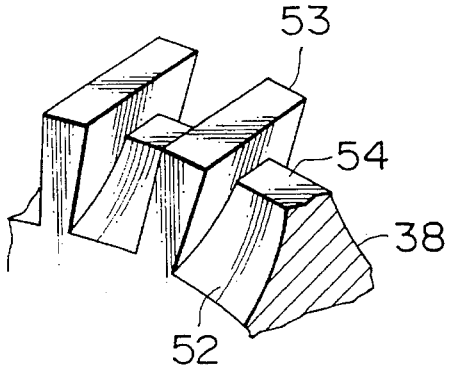
FIG. 10 is a perspective view showing an impeller of the second embodiment.

In FIGS. 9 and 10 showing the second embodiment, component parts corresponding to those of the structure described in the first embodiment are denoted by the same reference numerals so that changed component parts will be newly described.

In the second embodiment, each of vane members 53 formed on an impeller 38 extends over both sides of the impeller 38, as shown in FIG. 10. More specifically, the vane members 53 are formed on the impeller 38 at predetermined pitches while vane grooves 52 are defined therebetween, and further, each of the vane grooves 52 is divided into two sections facing both sides by a partition wall 54. A damping portion 51 which is a recess having substantially the same shape as the first embodiment is formed in a terminal end portion of a pump flow passage 44 of a casing cover 37.

In the second embodiment as well, fuel which has flowed in the damping portion 51 from the terminal end portion successively collides against a slanting wall surface 51*c* which surrounds the damping portion 51, so that noises generated by collision of the fuel can be reduced in substantially the same manner as the first embodiment.

In the impeller of the second embodiment, since each vane member 53 extends over both sides of the impeller, noises generated when the vane members 53 enter a partition portion 47 are larger as compared with the impeller described in the first embodiment. However, the second embodiment includes the damping portion 51 so as to suppress an increase of the noises, so that the impeller from which a high pumping efficiency can be obtained can be used.

Figure 11A:
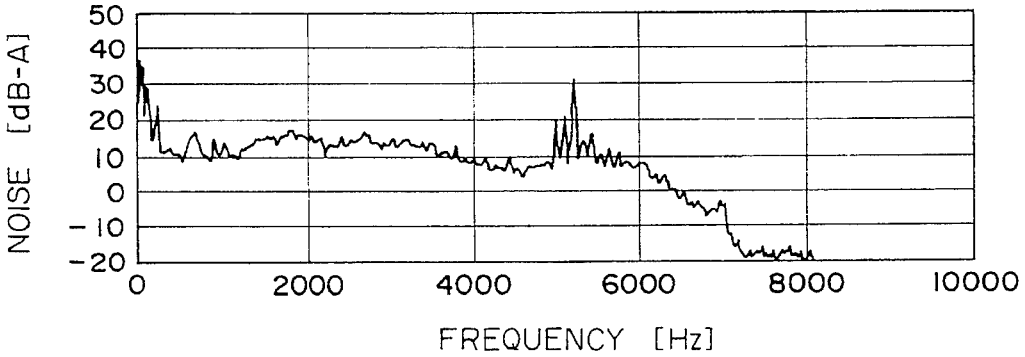
FIGS. 11A and 11B are graphs illustrative of frequency characteristics for explaining a noise preventing effect of the second embodiment.
Figure 11B:
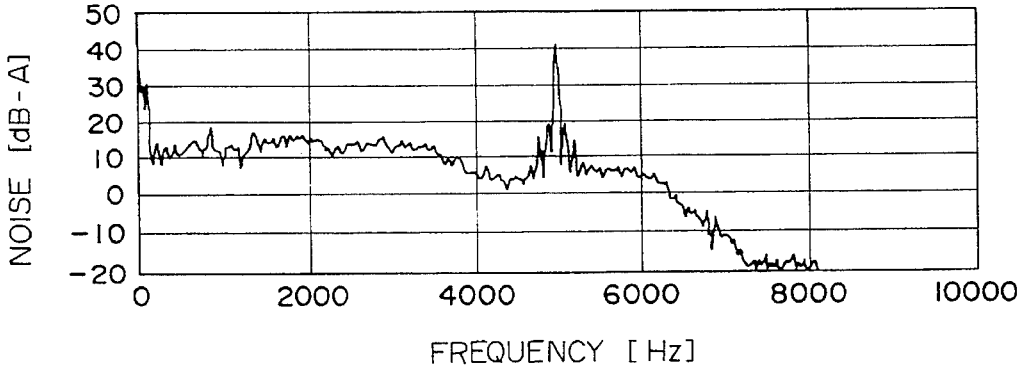

FIGS. 11A and 11B illustrate frequency characteristics of noises generated by the embodiment described above when it includes the damping portion 51 and when it does not include the damping portion 51, respectively. As understood from the frequency characteristics, the peak of the noise is decreased from 40 dB-A to 30 dB-A when the damping portion 51 is provided. Noises were measured at a position 10 cm above the fuel pump.

A third embodiment to which the invention is applied will now be described.

In the third embodiment, damping portions are formed in both a casing cover 37 and a casing body 36. As an impeller, the one in the second embodiment is used whereas the rest of the structure is substantially the same as the first embodiment.

Figure 12:
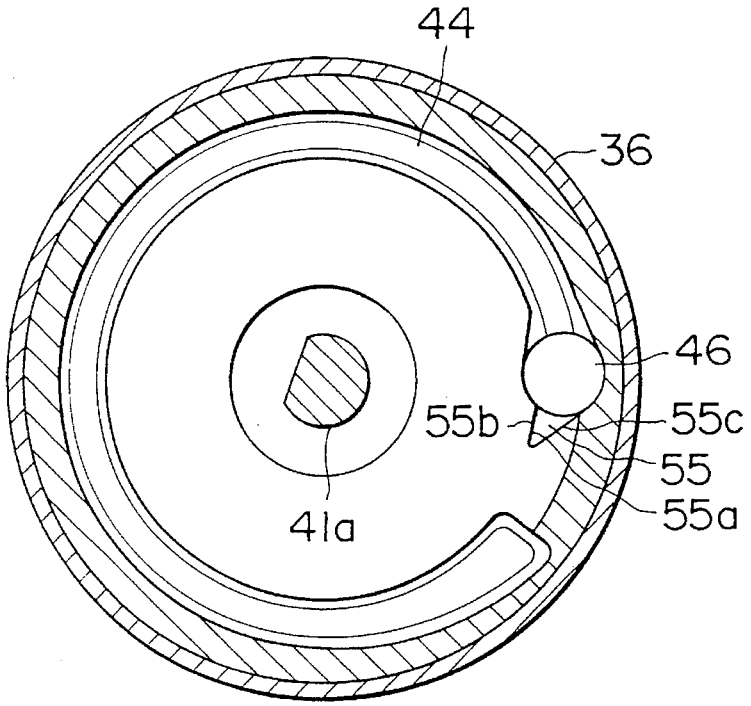
FIG. 12 is a cross-sectional view showing a casing body of a third embodiment to which the invention is applied.
Figure 13:
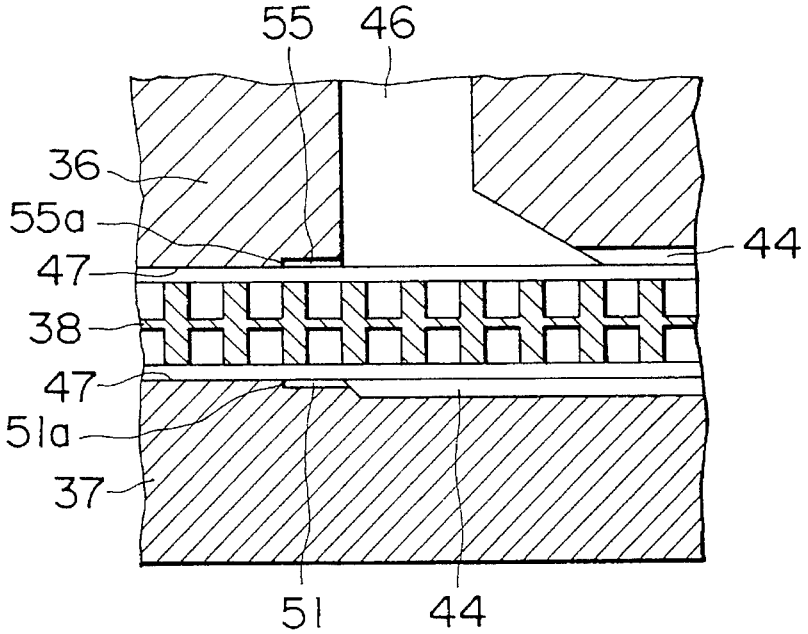
FIG. 13 is a cross-sectional view showing that portion of a fuel pump of the third embodiment which is located in the vicinity of a terminal end of a flow passage.

FIG. 12 shows the casing body 36 of the third embodiment, and is a cross-sectional view similar to FIG. 6 from which the impeller 38 is removed. FIG. 13 is a cross-sectional view similar to FIG. 8, showing the casing and impeller shapes of the third embodiment.

In the third embodiment, a damping portion 55 is formed in the casing body 36. This damping portion 55 has substantially the same shape as the damping portion 51 described in the first embodiment. The damping portion 55 is surrounded by a vertical wall 55*a* consisting of a circumferential wall surface 55*b* and a slanting wall surface 55*c*.

According to this embodiment, the impeller 38 receives pressures uniformly from fuel on both sides at the terminal end portion of the pump flow passage 44, thereby improving the pressure balance. As compared with the case where the damping portion is provided only on one side, the noise preventing effect is enhanced by the structure in which a pair of damping portions 51 and 55 are provided on both sides of the impeller. As a result of experiments performed by the inventors, however, a decrease in the noises was small.

When the damping portion 55 is formed in the casing body 36 and the damping portion 51 is formed in the casing cover 37, the impeller 38 receives pressures uniformly from fuel on both sides at the terminal end portion of the pump flow passage 44, thereby improving the pressure balance. In this case, those portions of the opposite surfaces of the impeller 38 which receive the pressures of the fluid should preferably be located at positions on both sides of the impeller 38 which are opposed to each other.

The damping portions 51, 55 of the third embodiment are surrounded by the vertical walls 51*a*, 55*a* which extend perpendicular to the inner surfaces of the casing body 36 and the casing cover 37. Consequently, when the inner surfaces of the casing body 36 and the casing cover 37 which are formed by die casting are ground to obtain a predetermined plane accuracy, the damping portions 51, 55 can be formed at desired positions. Therefore, there arises no such problem of the conventional technique that the terminal end of the pump flow passage which is formed with an inclined surface or a chamfered surface is changed to a different position. Since the positions of pressures of the fluid applied to both sides of the impeller 38 are not deviated from each other, it is possible to prevent the impeller 38 from vibrating in the axial direction while reducing the noises generated by the collision of the fuel.

Next, a fourth embodiment of the invention will be described.

In the fourth embodiment, the circular portion shown in FIG. 7 of the first embodiment is not formed in the terminal end of a flow passage 44, and a damping portion having substantially the same depth as the pump flow passage 44 is formed.

Figure 14:
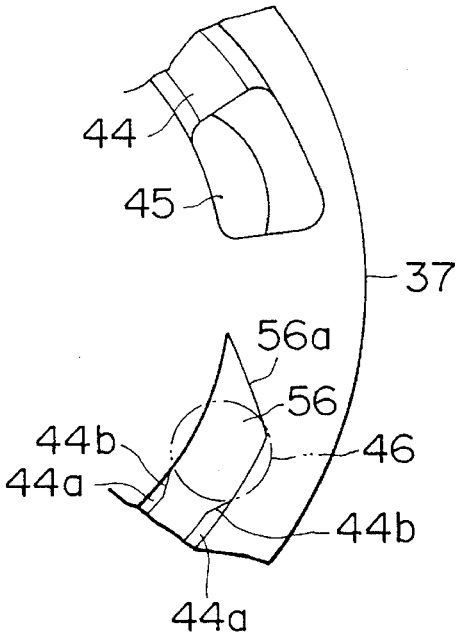
FIG. 14 is a partial plan view showing a casing cover of a fourth embodiment to which the invention is applied.

FIG. 14 is a partial plan view showing a pump cover 37 of the fourth embodiment.

In the first embodiment, the damping portion 51 in the form of a recess having a small depth is connected to the terminal end portion of the pump flow passage 44. In the fourth embodiment, however, the terminal end portion of the pump flow passage 44 is tapered, as shown in FIG. 14, and this tapered portion is employed as a damping portion 56. In this case, the damping portion 56 is surrounded by a vertical wall 56*a* which consists of a circumferential wall surface 56*b* and a slanting wall surface 56*c*. The vertical wall 56*a* of the damping portion 56 is made smoothly continuous to inner and outer slanting surfaces 44*a* of the pump flow passage 44, and connecting portions 44*b* to change an angle between the wall surfaces gradually are formed between the vertical wall 56*a* and the slanting surfaces 44*a*.

A damping portion having substantially the same shape may be formed in a casing body 36.

A fifth embodiment of the invention will now be described.

In the fifth embodiment, the triangular damping portion 51 described in the first embodiment is changed into a rectangular shape.

Figure 15:
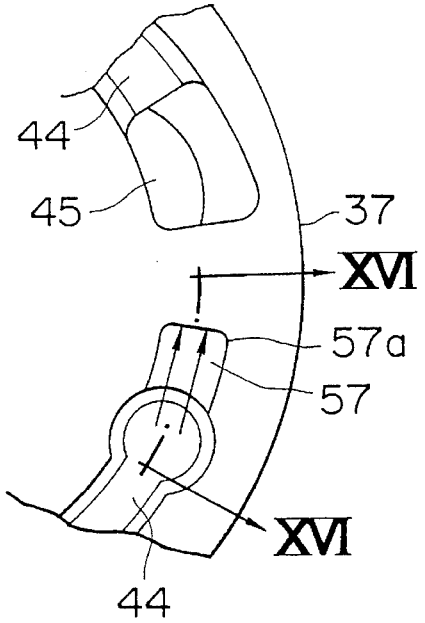
FIG. 15 is a partial plan view showing a casing cover of a fifth embodiment to which the invention is applied.
Figure 16:
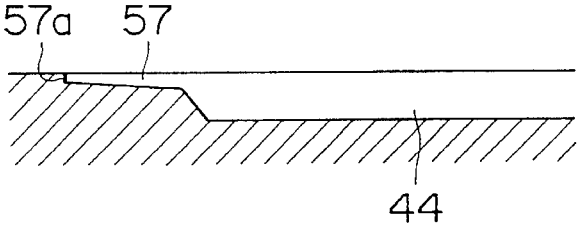
FIG. 16 is a cross-sectional view taken along the line XVI—XVI of FIG. 15.

FIG. 15 is a partial plan view showing a casing cover 37 of the fifth embodiment. FIG. 16 is a cross-sectional view taken along the line XVI—XVI of FIG. 15. In the fifth embodiment, a damping portion 57 in the form of a recess having a small depth is provided, and the depth of its bottom surface is made gradually smaller along the rotating direction of an impeller 38. However, the damping portion 57 is surrounded by a vertical wall 57*a*.

As compared with the conventional casing with no damping portion, the fifth embodiment can reduce the noises. However, the noise preventing effect is inferior to the effect of the damping portion 51 of the first embodiment. This is probably because the damping portion 57 of the fifth embodiment does not include a slanting wall surface. From this fact, it is presumed that the slanting wall surface which causes the vane members of the impeller to enter the partition portion gradually plays an important role in obtaining an excellent noise preventing effect.

A sixth embodiment of the invention will now be described.

In the sixth embodiment, the damping portion described in the first embodiment is designed to have two slanting wall surfaces.

Figure 17:
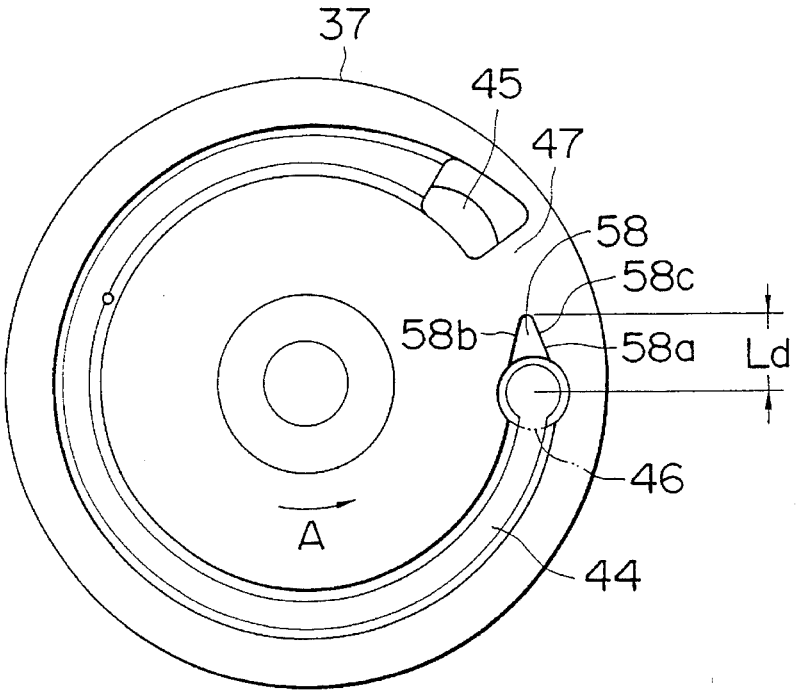
FIG. 17 is a plan view showing a casing cover of a sixth embodiment to which the invention is applied.

FIG. 17 is a plan view showing a casing cover 37 of the sixth embodiment. A damping portion 58 in the form of a triangular recess having a small depth is formed in the terminal end of a pump flow passage 44. The damping portion 58 is shaped as a triangle whose apex is located on the radial center of each vane member 49 of an impeller 38, and is surrounded by a slanting wall surface 58*b* extending from a position substantially corresponding to the bottom end of the vane member 49 of the impeller 38 and a slanting wall surface 58*c* extending from a position substantially corresponding to the distal end of the vane member 49.

According to the sixth embodiment, the damping portion 58 is surrounded by the vertical wall 58*a*, so that the damping portion 58 can be prevented from deforming when the inner surface of the casing cover 37 is ground. Further, since the damping portion 58 is formed of the slanting wall surfaces, fuel at a pressure increased in response to the movement of the vane members collides gradually, and also, the vane members 49 of the impeller 38 are gradually hidden in a partition portion 47 from both the bottom end side and the distal end side, thereby obtaining a high noise preventing effect.

Next, a seventh embodiment of the invention will be described.

In the seventh embodiment, the damping portion described in the first embodiment is designed to have a slanting wall surface located on the inner side and a circumferential wall surface located on the outer side.

Figure 18:
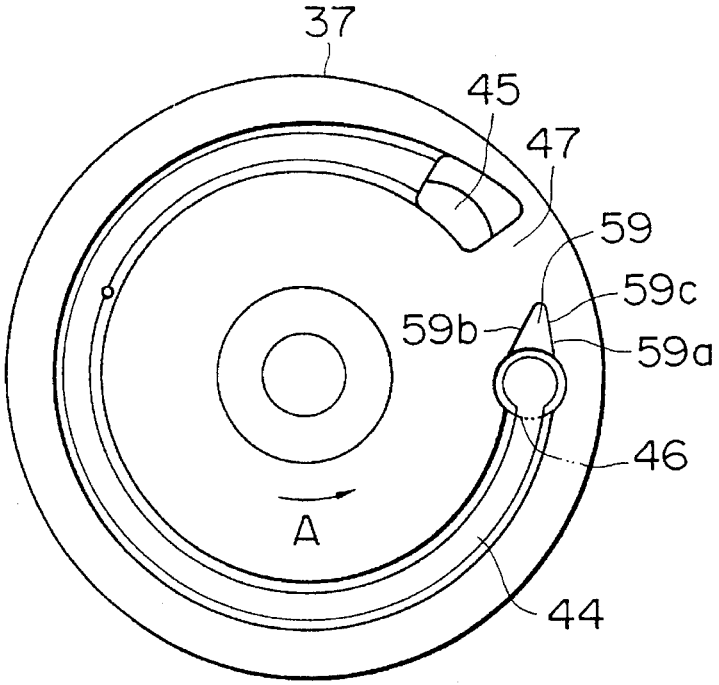
FIG. 18 is a plan view showing a casing cover of a seventh embodiment to which the invention is applied.

FIG. 18 is a plan view showing a casing cover 37 of the seventh embodiment. A damping portion 59 in the form of a triangular recess having a small depth is formed in the terminal end of a pump flow passage 44. The damping portion 59 is shaped as a triangle whose apex is located on the radial distal end of each vane member 49 of an impeller 38, and is surrounded by a slanting wall surface 59*b* extending from a position substantially corresponding to the bottom end of the vane member 49 of the impeller 38 and a circumferential wall surface 58*c* extending in the circumferential direction substantially from the distal end of the vane member 49.

According to the seventh embodiment, the damping portion 59 is surrounded by the vertical wall 59*a*, so that the shape of the damping portion 59 can be prevented from changing when the inner surface of the casing cover 37 is ground. Further, since the inner boundary line of the damping portion 59 is defined by the slanting wall surface, fuel at a pressure increased in response to the movement of the vane members collides gradually, and also, the vane members 49 of the impeller 38 are gradually hidden in a partition portion 47 from both the bottom end side and the distal end side, thereby obtaining a high noise preventing effect.

An eighth embodiment to which the invention is applied will now be described.

In the eighth embodiment, the impeller 38 in the third embodiment is changed into an impeller disclosed in Japanese Patent Application No. 5-254135.

Figure 19:
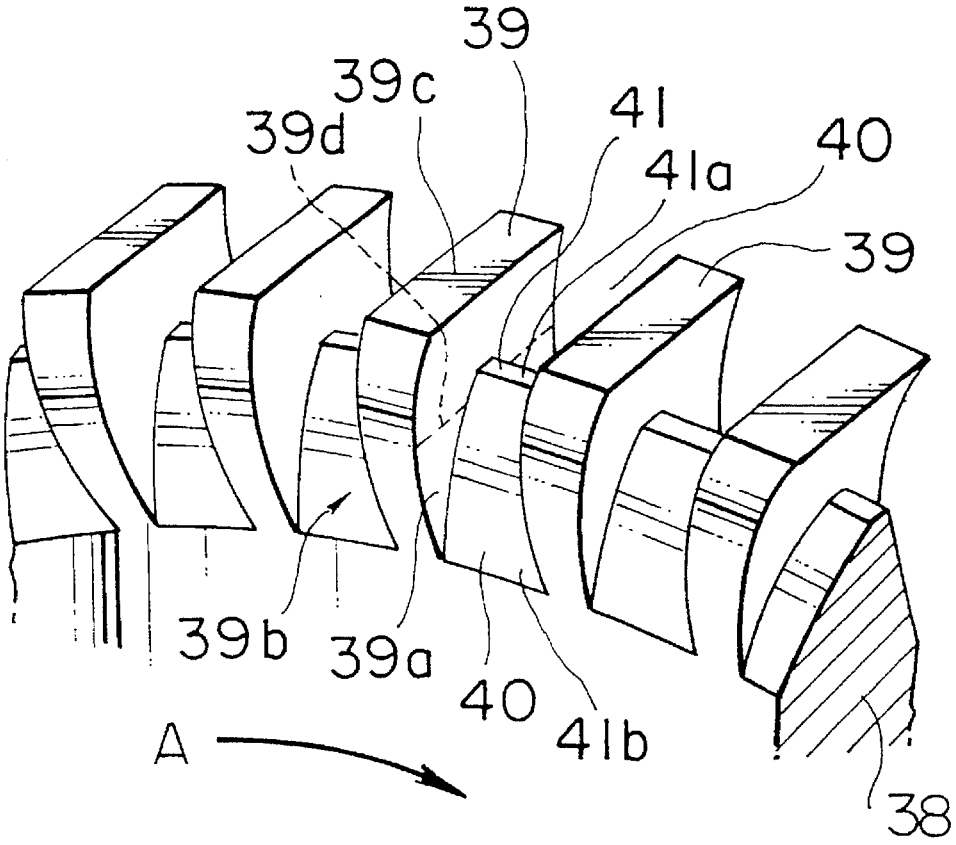
FIG. 19 is a perspective view showing an impeller of an eighth embodiment to which the invention is applied.

FIG. 19 is a partially broken-away perspective view showing the impeller of the eighth embodiment.

The impeller 38 of the eighth embodiment is obtained by further improving the impeller described in the second embodiment in such a manner that vane members are curved to be concave with respect to the rotating direction.

A high pumping efficiency can be obtained from the impeller of the eighth embodiment. However, since each vane member 53 is formed continuously extending over the opposite surfaces of the impeller, noises when the vane members 53 enter a partition portion 47 are larger as compared with the impeller described in the first embodiment. In the eighth embodiment, however, the damping portions 51, 55 are formed in the terminal end of a pump passage 44 both on the casing body 36 side and on the casing cover 37 side, as described in the third embodiment, so that generation of noises can be adequately suppressed even if the impeller from which a high pumping efficiency can be obtained is used.

According to the results of experiments performed by the inventors, it was confirmed that a combination of the impeller shown in FIG. 19 and the casing shown in FIG. 13 exhibited the highest pumping efficiency and generated low noises.

Next, the results of an experiment in relation to the depth of a damping portion will be described.

Figure 20:
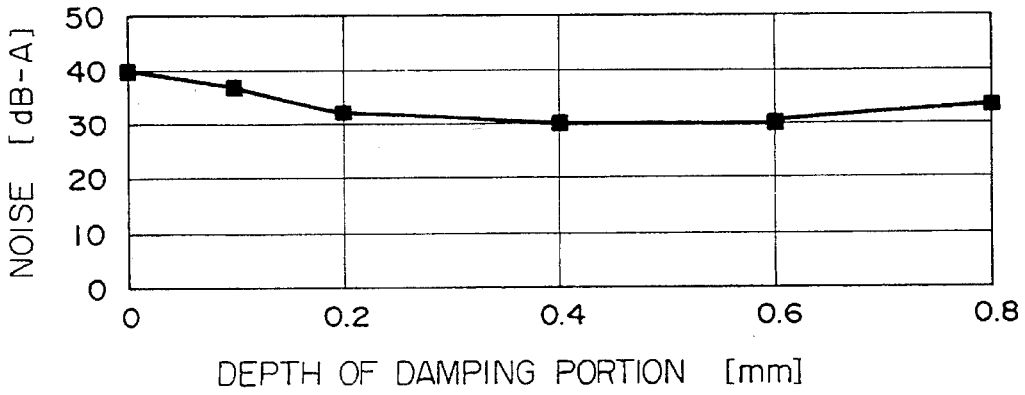
FIG. 20 is a graph illustrative of a relation between the depth of a damping portion and noises.

FIG. 20 is a graph showing noises when the depths of the damping portions 51, 55 in the structure described in the third embodiment varied. In this experiment, the distal ends of the damping portions 51, 55 have corner portions having a radius of 0.5 mm. The length L from the center of the circular terminal end portion of the pump flow passage 44 to the distal end of the damping portion 51 is 4 mm. The depth of the pump flow passage 44 is 0.6 mm.

As obvious from FIG. 20, the damping portion 51 produces a sufficient effect when the depth is 0.2 mm or more. Besides, the effect is hardly changed while the depth is in a range from 0.2 mm to 0.8 mm. In the case where a casing cover 37 is formed by die casting of aluminum and the inner surface thereof is ground to obtain plane accuracy, an amount of grinding of the inner surface varies because a deviation in the grinding work is enhanced by a deviation in the material, thereby changing the depth of the damping portion 51. However, since the noise reduction effect is not very different when the depth is 0.2 mm or more, as described above, the depth of the damping portion is determined at about 0.4 mm so that an adequate noise reduction effect can be obtained even if a decrease in the dimensional accuracy caused by mass production is considered.

Figure 21:
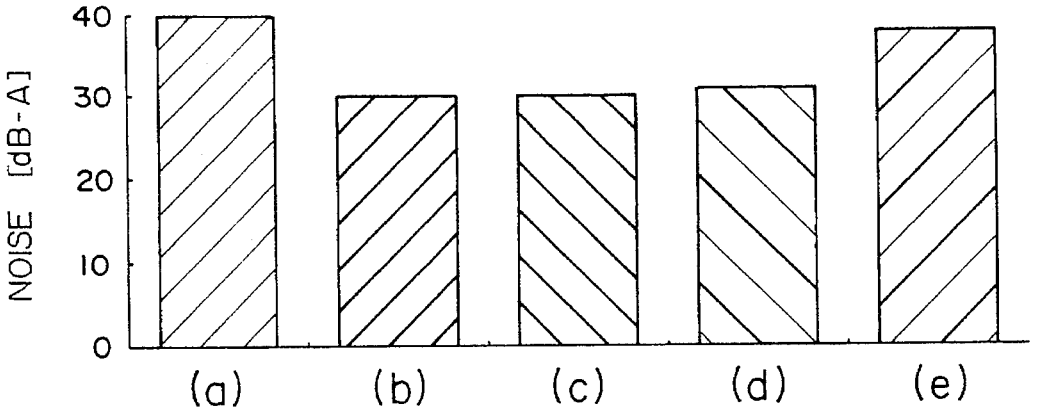
FIG. 21 is a graph illustrative of a relation between the embodiments of the invention and noises.
Figure 22:
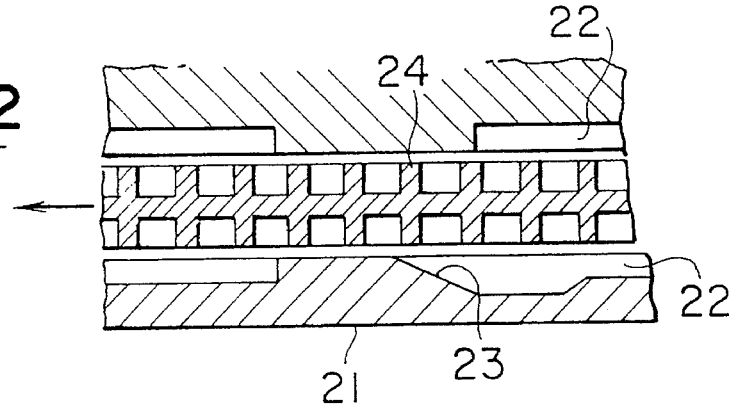
FIG. 22 PRIOR ART
FIG. 22 is a cross-sectional view showing that portion of a conventional regenerative pump which is located in the vicinity of a partition portion.
Figure 23:
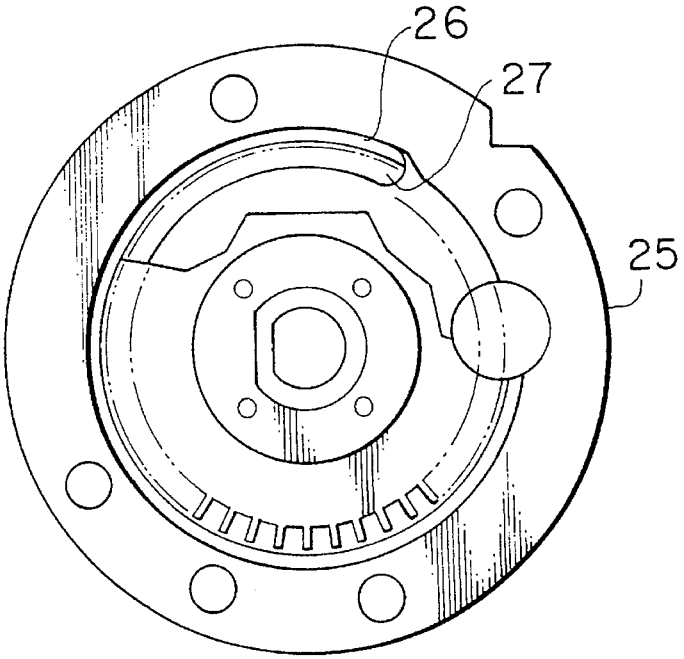
FIG. 23 PRIOR ART
FIG. 23 is a plan view showing a casing of a conventional fuel pump.
Figure 24:
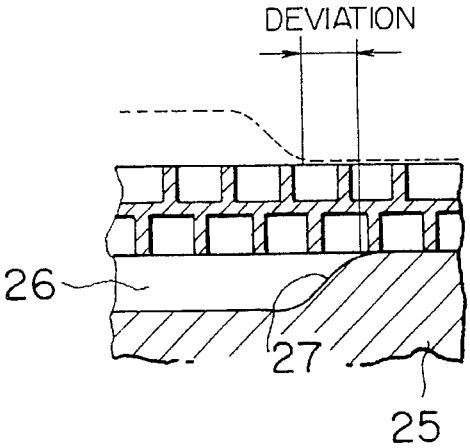
FIG. 24 PRIOR ART
FIG. 24 is a cross-sectional view showing that portion of the pump shown in FIG. 23 which is located in the vicinity of a terminal end of a flow passage.

Noise reduction effects when the shape of a damping portion is changed will be described with reference to FIG. 21. In FIG. 21, (a) shows the noise when the impeller described in the second embodiment is housed in the casing without damping portions. Further, (b) shows the noise of the second embodiment, (c) shows the noise of the sixth embodiment, (d) shows the noise of the seventh embodiment, and (e) shows the noise of the fifth embodiment. In any of the above embodiments, the impeller described in the second embodiment is used, and a damping portion is formed only on the casing cover 37 side. In this experiment, the corner of the damping portion has a radius of 0.5 mm. The length Ld from the center of the circular terminal end portion of the pump flow passage 44 to the distal end part of the damping portion 51 is 4 mm. The depth dd of the damping portion is 0.4 mm. The depth of the pump flow passage 44 is 0.6 mm.

As easily understood from this graph, a noise reduction effect can be obtained, however small, by the rectangular damping portion as in the fifth embodiment. A large noise reduction effect can be obtained by the damping portion having a boundary line which slants with respect to the vane member of the impeller, as in the second, sixth and seventh embodiments although the damping portions have similar depths.

The triangular damping portion has such a tendency that if the length Ld of the damping portion is too short, the noise reduction effect is lowered to thereby increase the noises, and on the other hand, if the length Ld is increased, the noise reduction effect is improved to thereby reduce the noises. This is presumably because the enlargement of the angle of the slanting boundary line of the damping portion with respect to the vane member of the impeller contributes to reduction of the noises. However, if the length Ld is too long, the length of the partition portion 47 becomes insufficient, thus lowering the pumping efficiency. Therefore, the length of the damping portion in the rotating direction of the impeller should not be excessively increased. Consequently, the length Ld of the damping portion should be determined at an appropriate value considering the angle between the boundary line surrounding the damping portion and the vane member, and the length of the partition portion.

In each of the above-described embodiments, as shown in FIGS. 8 and 13, the slanting wall surface is designed in such a manner that at least one vane member is always located in the range of the slanting wall surface, i.e., the slanting wall surface slants over the range longer than the pitch between the vane members. Since a high noise preventing effect can be obtained from this structure, the slanting boundary line should preferably be formed to extend at least over the range of the pitch between the vane members.

Further, the slanting boundary line should preferably be formed to extend from the radial bottom end to the radial distal end of the vane member. However, the slanting boundary line may be formed only over a part of the radial range of the vane member.

In this manner, in order to improve the noise reduction effect, it is presumably an important factor that the damping portion is defined by the boundary line which is at a large angle with respect to the vane member of the impeller. Therefore, the noise reduction effect of the rectangular damping portion, as in the fifth embodiment, can be improved by enlarging the angle between the boundary line of the damping portion at the terminal end side and the vane member of the impeller. Moreover, the boundary line of the damping portion may be arranged in such a manner that the vane member of the impeller gradually enters the partition portion.

Heretofore, the preferred embodiments to which the invention is applied have been described. However, the invention is not limited to a fuel pump of an automobile but can be widely applied as a pump for pressurizing and supplying various kinds of fluid such as water. Further, the invention is not limited to the impeller including vane members and vane grooves formed only on the outer periphery thereof but can be applied to a pump of a so-called side channel type including a plurality of channels formed on an end face of a disk-like impeller. Moreover, the invention can be modified in various manners within the spirit of the invention.

According to the present invention, as described above, there can be provided a regenerative pump, a fuel pump and their casings which generate low noises.

Besides, the damping portion is formed by the vertical wall so that deformation of the damping portion can be prevented, thus providing a practical structure by which a desired noise preventing effect and a desired pumping performance can be obtained reliably.

Furthermore, the boundary line of the recessed fluid flow passage is formed to permits the vane member of the impeller to enter the partition portion gradually, thereby obtaining a high noise preventing effect.

What is claimed is:

1. A regenerative pump comprising:

a casing which a recessed fluid flow passage interconnecting a suction port and a discharge port is formed in an arcuate shape; and an impeller provided rotatably with respect to said casing and formed with a plurality of vane members which face said recessed fluid flow passage, wherein a recessed damping portion is formed in a terminal end portion of said recessed fluid flow passage on a discharge port side thereof to begin at a position corresponding to the discharge port and extend along a rotating direction of said impeller, and said recessed damping portion has a depth which is smaller than that of a main depth of said recessed fluid flow passage and substantially constant.

2. A regenerative pump according to claim 1, wherein said recessed damping portion is defined by a boundary line which causes each vane member of said impeller to enter a partition portion gradually.

3. A regenerative pump according to claim 2, wherein said casing extends in a range which holds said impeller from both opposite sides thereof, said recessed fluid flow passage includes a first section which faces one of surfaces of said impeller and a second section which faces the other surface of said impeller, the discharge port extends from a terminal end of said first section perpendicularly to the surfaces of said impeller, and said damping portion is formed at least in a terminal end portion of said second section and further extends from a vertically projected position of said discharge port along the rotating direction of the impeller.

4. A regenerative pump according to claim 1, wherein said recessed damping portion is surrounded by a vertical wall which extends substantially perpendicularly to inner surfaces of said casing.

5. A regenerative pump according to claim 4, wherein said vertical wall includes a wall surface which permits each vane member of said impeller to enter a partition portion gradually.

6. A regenerative pump according to claim 5, wherein said casing extends in a range which holds said impeller from both opposite sides thereof, said recessed fluid flow passage includes a first section which faces one of surfaces of said impeller and a second section which faces the other surface of said impeller, the discharge port extends from a terminal end of said first section perpendicularly to the surfaces of said impeller, and said damping portion is formed at least in a terminal end portion of said second section and further extends from a vertically projected position of the discharge port along the rotating direction of said impeller.

7. A regenerative pump according to claim 6, wherein another damping portion is formed in the terminal end portion of said first section.

8. A regenerative pump according to claim 7, wherein said impeller is formed in a disk-like shape, and the vane members are formed to extend continuously from one of end faces of said impeller to the other end face thereof.

9. A regenerative pump according to claim 8, wherein the vane members of said impeller are concave with respect to the rotating direction of said impeller.

10. A regenerative pump according to claim 9, wherein the pump supplies fuel to an internal combustion engine.

11. A regenerative pump according to claim 1, wherein said casing extends in a range which holds said impeller from opposite sides, said recessed fluid flow passage includes a first section which faces one of surfaces of said impeller and a second section which faces the other surface of said impeller, the discharge port extends from a terminal end of said first section perpendicularly to the surfaces of said impeller, and said damping portion is formed at least in a terminal end portion of said second section and further extends from a vertically projected position of the discharge port along the rotating direction of said impeller.

12. A regenerative pump according to claim 1, wherein said impeller is formed in a disk-like shape, and the vane members are formed individually on one end face of said impeller and on another end face thereof.

13. A regenerative pump comprising: a casing in which a recessed fluid flow passage interconnecting a suction port and a discharge port is formed in an arcuate shape; and an impeller provided rotatably with respect to the formed with a plurality of vane members which face the recessed fluid flow passage, wherein a recessed damping portion is formed in a terminal end portion of said recessed fluid flow passage on a discharge port side thereof to begin at a position corresponding to the discharge port and extend along a rotating direction of said impeller, and said recessed damping portion is surrounded by a vertical wall which extends substantially perpendicularly to inner surfaces of said casing.

14. A regenerative pump according to claim 13, wherein said vertical wall includes a wall surface which permits each vane member of said impeller to enter a partition portion gradually.

15. A regenerative pump according to claim 14, wherein said casing extends in a range which holds said impeller from both opposite sides, said recessed fluid flow passage includes a first section which faces one of surfaces of said impeller and a second section which faces the other surface of said impeller, the discharge port extends from a terminal end of said first section perpendicularly to the surfaces of said impeller, and said damping portion is formed at least in a terminal end portion of said second section and further extends from a vertically projected position of the discharge port along the rotating direction of said impeller.

16. A regenerative pump according to claim 15, wherein another damping portion is formed in the terminal end portion of said first section.

17. A regenerative pump according to claim 16, wherein said impeller is formed in a disk-like shape, and the vane members are formed to extend continuously from one of end faces of said impeller to the other end face thereof.

18. A regenerative pump according to claim 17, wherein the vane members of said impeller are concave with respect to the rotating direction of said impeller.

19. A regenerative pump according to claim 18, wherein the pump supplies fuel to an internal combustion engine.

20. A regenerative pump according to claim 13, wherein said casing extends in a range which holds said impeller from opposite sides, said recessed fluid flow passage includes a first section which faces one of surfaces of said impeller and a second section which faces the other surface of said impeller, said discharge port extends from a terminal end of said first section perpendicularly to the surfaces of said impeller, and said damping portion is formed at least in a terminal end portion of said second section and further extends from a vertically projected position of the discharge port along the rotating direction of said impeller.

21. A regenerative pump according to claim 13, wherein said impeller is formed in a disk-like shape, and the vane members are formed individually on one end face of said impeller and on another end face thereof.

* * * * *